US012376619B2

(12) United States Patent
Lee

(10) Patent No.: US 12,376,619 B2
(45) Date of Patent: Aug. 5, 2025

(54) AEROSOL-GENERATING ARTICLE

(71) Applicant: KT&G CORPORATION, Daejeon (KR)

(72) Inventor: Moon Bong Lee, Seoul (KR)

(73) Assignee: KT&G CORPORATION, Daejeon (KR)

( * ) Notice: Subject to any disclaimer, the term of this patent is extended or adjusted under 35 U.S.C. 154(b) by 0 days.

(21) Appl. No.: 17/767,239

(22) PCT Filed: Nov. 2, 2021

(86) PCT No.: PCT/KR2021/015679
§ 371 (c)(1),
(2) Date: May 19, 2022

(87) PCT Pub. No.: WO2022/103052
PCT Pub. Date: May 19, 2022

(65) Prior Publication Data

US 2024/0099362 A1 Mar. 28, 2024

(30) Foreign Application Priority Data

Nov. 10, 2020 (KR) ..... 10-2020-0149290

(51) Int. Cl.
*A24D 3/04* (2006.01)
*A24D 1/04* (2006.01)

(52) U.S. Cl.
CPC *A24D 3/04* (2013.01); *A24D 1/04* (2013.01)

(58) Field of Classification Search
None
See application file for complete search history.

(56) References Cited

U.S. PATENT DOCUMENTS 4,393,885 A * 7/1983 Silberstein ..... A24D 3/04 131/339
2013/0180535 A1 7/2013 Rooijakkers et al.
2015/0020822 A1* 1/2015 Janardhan ..... A61M 15/06 131/328
2019/0021399 A1 1/2019 Silvestrini
2019/0083720 A1* 3/2019 Leadley ..... A61M 15/06
(Continued)

FOREIGN PATENT DOCUMENTS

CN 204426701 U 7/2015
CN 107343670 A 11/2017
(Continued)

OTHER PUBLICATIONS

International Search Report of PCT/KR2021/015679 dated Feb. 8, 2022 [PCT/ISA/210].
(Continued)

*Primary Examiner* — Philip Y Louie
*Assistant Examiner* — Nicole A Szumigalski
(74) *Attorney, Agent, or Firm* — Sughrue Mion, PLLC

(57) ABSTRACT

An aerosol-generating article according to an embodiment of the disclosure includes: a tobacco rod; a filter rod located downstream of the tobacco rod; and a wrapper surrounding outer circumferential surfaces of the tobacco rod and the filter rod, wherein the tobacco rod includes: a structure supporting the wrapper in a transverse direction; and at least one channel formed between the wrapper and the structure.

1 Claim, 5 Drawing Sheets

230: 232, 234, 236

(56) References Cited

U.S. PATENT DOCUMENTS

| | | | | |
|---|---|---|---|---|
| 2020/0029616 | A1 | 6/2020 | Uthurry | |
| 2020/0268042 | A1* | 8/2020 | Ognibene | A24D 3/0275 |
| 2020/0323274 | A1 | 10/2020 | Qiu et al. | |
| 2021/0093009 | A1 | 4/2021 | Park et al. | |
| 2022/0079221 | A1 | 3/2022 | Lee | |
| 2022/0232885 | A1* | 7/2022 | Batista | A24D 3/045 |
| 2022/0312831 | A1 | 10/2022 | Watanabe | |

FOREIGN PATENT DOCUMENTS

| | | | | |
|---|---|---|---|---|
| CN | 209219246 | U | 8/2019 | |
| CN | 110810905 | A | 2/2020 | |
| CN | 210580975 | U | 5/2020 | |
| CN | 211241733 | U | 8/2020 | |
| CN | 211794287 | U | 10/2020 | |
| CN | 111885932 | A | 11/2020 | |
| EP | 0109608 | A1 | 5/1984 | |
| EP | 3 689 159 | A1 | 8/2020 | |
| JP | S51-14298 | U | 2/1976 | |
| KR | 10-2018-0070516 | A | 6/2018 | |
| WO | 2014/049494 | A1 | 4/2014 | |
| WO | 2015/177045 | A1 | 11/2015 | |
| WO | 2019/030274 | A1 | 2/2019 | |
| WO | WO-2020025728 | A1 * | 2/2020 | A24B 15/12 |
| WO | 2020/201566 | A1 | 10/2020 | |
| WO | 2020/211753 | A1 | 10/2020 | |
| WO | 2020200693 | A1 | 10/2020 | |
| WO | 2021/117407 | A1 | 6/2021 | |

OTHER PUBLICATIONS

Extended European Search Report dated Nov. 22, 2022 from the European Patent Office in EP Application No. 21870510.1.

Office Action issued Mar. 24, 2023 in Chinese Application No. 202180006319.3.

Office Action issued May 9, 2023 in Japanese Application No. 2022-525470.

Japanese Office Action issued Nov. 7, 2023 in Application No. 2022-525470.

* cited by examiner

[Fig. 1]
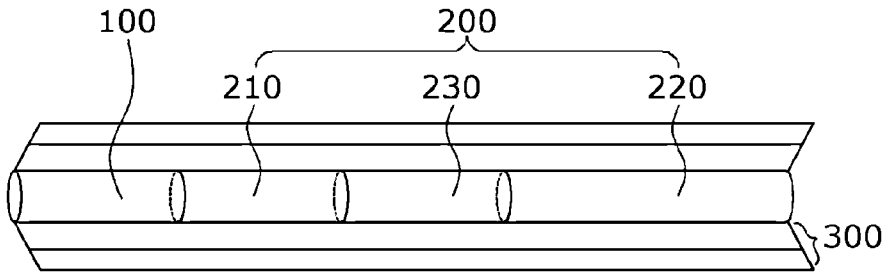
[Fig. 2]
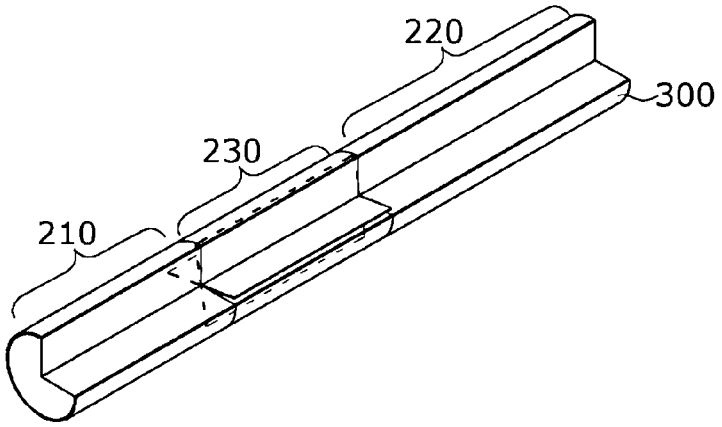
200 : 210, 220, 230
[Fig. 3]
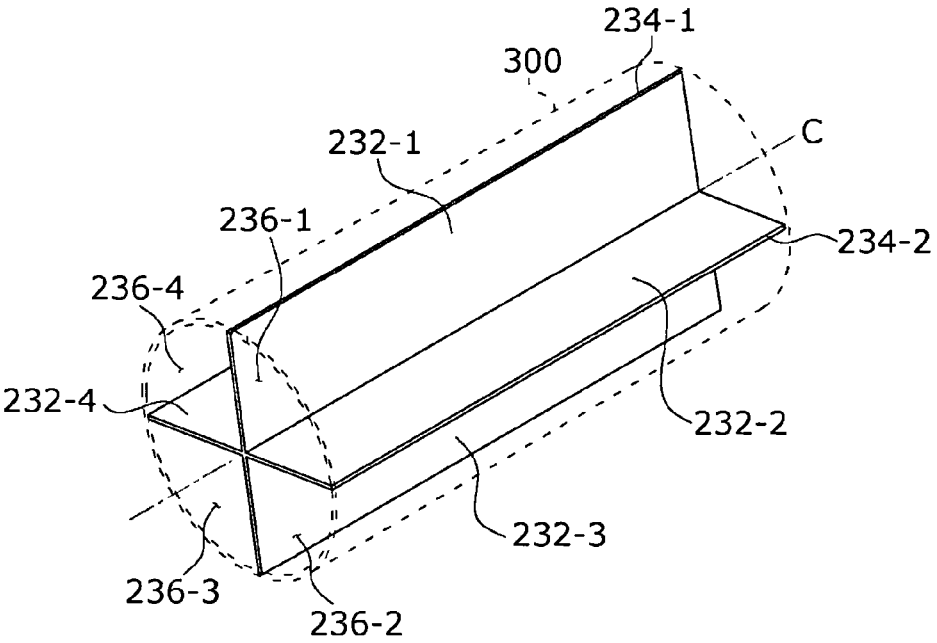
230 : 232, 234, 236
232 : 232-1, 232-2, 232-3, 232-4
234 : 234-1, 234-2
236 : 236-1, 236-2, 236-3, 236-4

[Fig. 4]
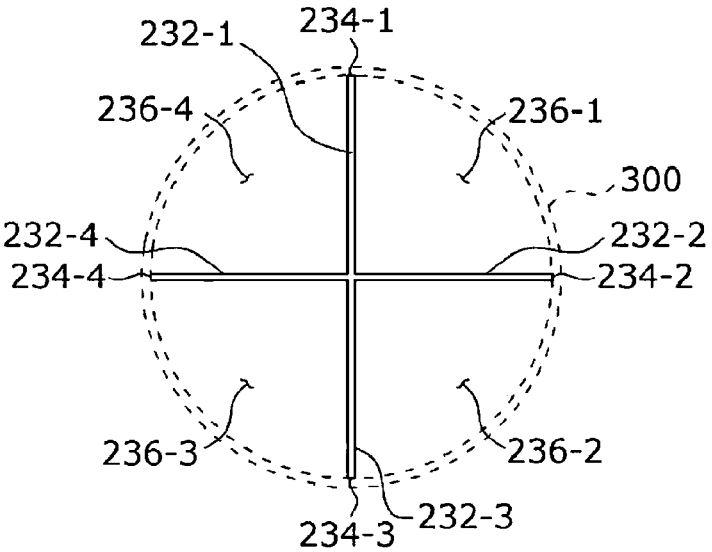
230 : 232, 234, 236
232 : 232-1, 232-2, 232-3, 232-4
234 : 234-1, 234-2, 234-3, 234-4
236 : 236-1, 236-2, 236-3, 236-4
[Fig. 5]
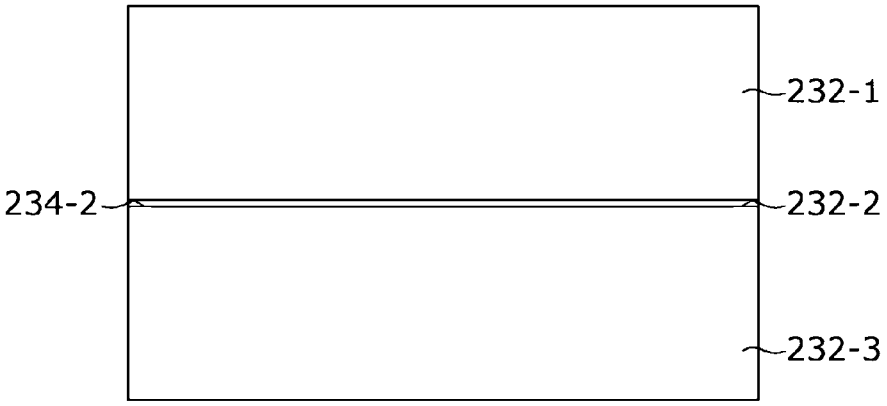
230 : 232, 234
232 : 232-1, 232-2, 232-3
234 : 234-2

[Fig. 6]
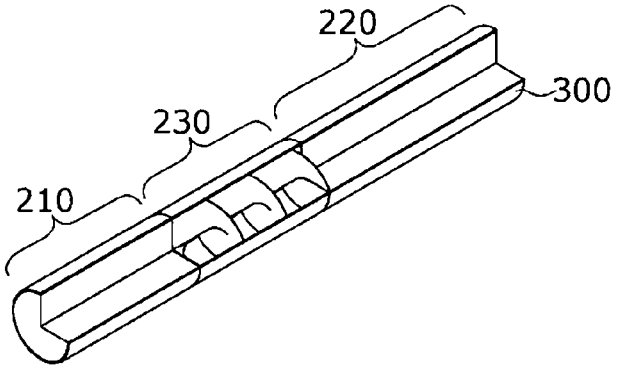
200 : 210, 220, 230
[Fig. 7]
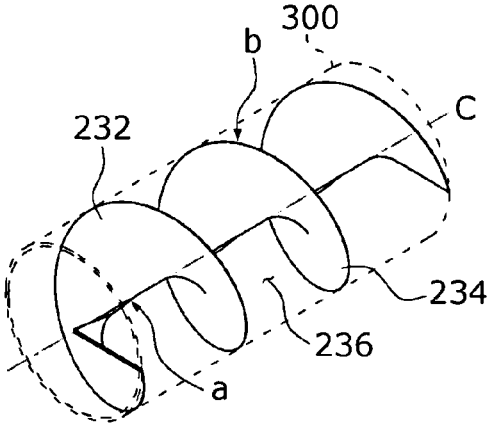
230 : 232, 234, 236
[Fig. 8]
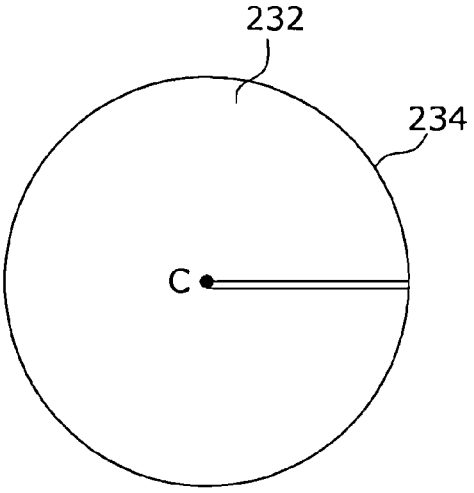
230 : 232, 234

[Fig. 9]
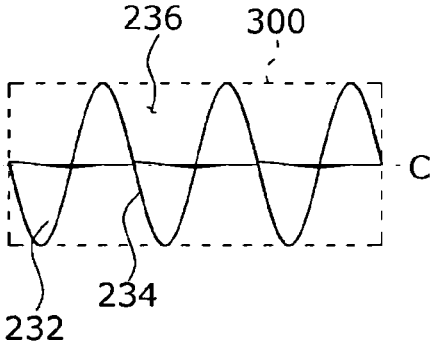
230 : 232, 234, 236
[Fig. 10]
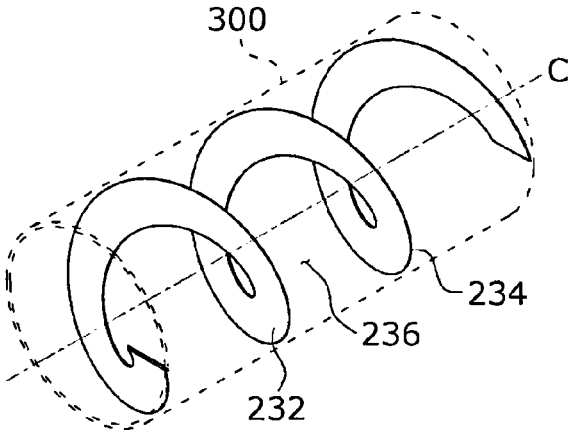
230: 232, 234, 236
[Fig. 11]
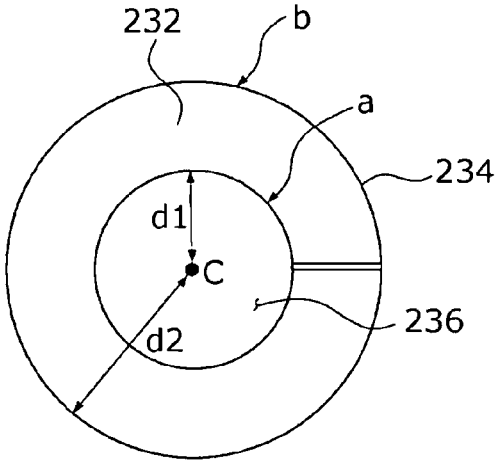
230: 232, 234, 236

[Fig. 12]
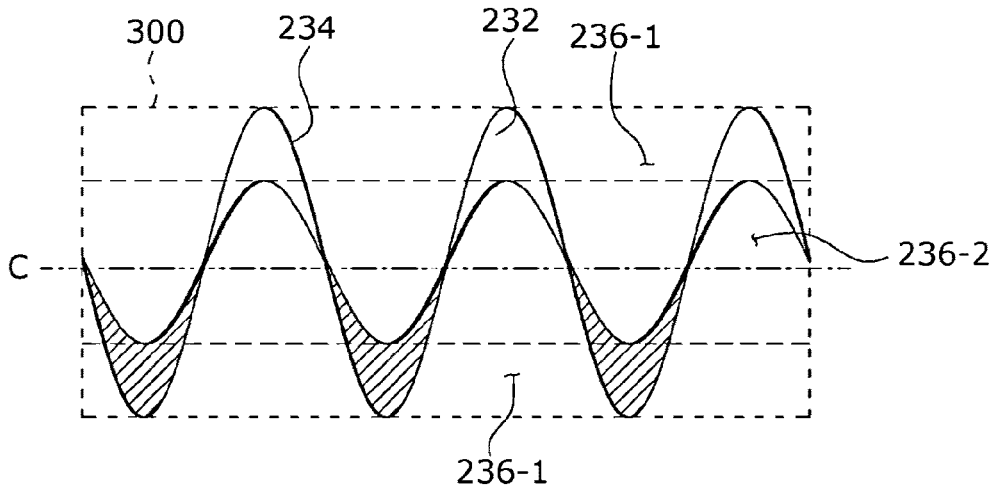
230: 232, 234, 236
236: 236-1, 236-2

AEROSOL-GENERATING ARTICLE

CROSS REFERENCE TO RELATED APPLICATIONS

This application is a National Stage of International Application No. PCT/KR2021/015679 filed on Nov. 2, 2021, claiming priority based on Korean Patent Application No. 10-2020-0149290 filed on Nov. 10, 2020.

TECHNICAL FIELD

Embodiments relate to an aerosol-generating article.

BACKGROUND ART

An aerosol-generating article such as a combustion-type cigarette or a non-combustion type (e.g., heating-type) cigarette includes a filter rod for filtering a specific component included in aerosol or cooling the aerosol. Recently, research for improving filter performance by changing components constituting a filter rod or changing a structure of the filter rod has been conducted.

During smoking, a user's mouth contacts a filter rod. When the filter rod is short, aerosol may not be sufficiently cooled, thereby causing burns to the user. In some aerosol-generating articles, in order to increase a length of the filter rod to a certain length or more, a space can be formed between segments and then wrapped with a wrapper.

However, when an external force is applied to the filter rod while the user holds the filter rod by hand or inserts the filter rod into a heating device, a shape of the filter rod may be distorted or bent, and thus there is a need for a solution to such a problem.

DISCLOSURE OF INVENTION

Technical Problem

A technical problem to be solved by the disclosure is to provide an aerosol-generating article capable of maintaining a shape of a filter rod even when an external force is applied.

Also, a technical problem to be solved by the disclosure is to provide an aerosol-generating article capable of improving homogeneity by mixing aerosol.

Technical problems to be solved by the disclosure are not limited thereto, and objectives or effects which may be derived from the following solution or embodiments may also be included.

Solution to Problem

An aerosol-generating article according to an embodiment of the disclosure includes: a tobacco rod; a filter rod located downstream of the tobacco rod; and a wrapper surrounding outer circumferential surfaces of the tobacco rod and the filter rod, wherein the filter rod includes: a structure supporting the wrapper in a transverse direction; and at least one channel formed between the wrapper and the structure.

The structure may include a plurality of support surfaces contacting an inner circumferential surface of the wrapper in a longitudinal direction.

The structure may further include a plurality of plates extending from a longitudinal axis to the inner circumferential surface of the wrapper.

An angle formed by two adjacent plates of the plurality of plates may be 180/n, n being a positive integer.

The plurality of plates may include: a first plate; a second plate perpendicular to the first plate; a third plate parallel to the first plate with the longitudinal axis located in between; and a fourth plate parallel to the second plate with the longitudinal axis located in between.

The structure may include at least one support surface spirally contacting an inner circumferential surface of the wrapper in a longitudinal direction.

The at least one channel may include a channel for forming a vortex of aerosol around a longitudinal axis.

The structure may further include a spiral plate member spirally formed along the longitudinal axis.

The structure may further include a hollow formed along the longitudinal axis.

An airflow of aerosol may be formed along the hollow.

A central portion of the structure along the longitudinal axis may be sealed.

Advantageous Effects of Invention

According to an embodiment of the disclosure, when an aerosol-generating article is stored and used, deformation of a shape may be minimized, and thus design characteristics may be maintained. As a result, a smoking feeling as intended through the design may be provided to a user.

Also, according to an embodiment of the disclosure, because aerosol is mixed by a vortex or the like when the aerosol flows through a channel, the homogeneity of the aerosol may be improved.

Various and beneficial advantages and effects of the disclosure are not limited thereto, and will be more easily understood in the course of describing specific embodiments of the disclosure.

BRIEF DESCRIPTION OF DRAWINGS

FIG. 1 is a view for describing an aerosol-generating article according to an embodiment of the disclosure.

FIG. 2 is a perspective view illustrating a filter rod including a segment according to a first embodiment of the disclosure.

FIG. 3 is a perspective view illustrating a third segment according to the first embodiment of the disclosure.

FIG. 4 is a front view illustrating the third segment according to the first embodiment of the disclosure.

FIG. 5 is a side view illustrating the third segment according to the first embodiment of the disclosure.

FIG. 6 is a perspective view illustrating a filter rod including a third segment according to a second embodiment of the disclosure.

FIG. 7 is a perspective view illustrating the third segment according to the second embodiment of the disclosure.

FIG. 8 is a front view illustrating the third segment according to the second embodiment of the disclosure.

FIG. 9 is a side view illustrating the third segment according to the second embodiment of the disclosure.

FIG. 10 is a perspective view illustrating a third segment according to a third embodiment of the disclosure.

FIG. 11 is a front view illustrating the third segment according to the third embodiment of the disclosure.

FIG. 12 is a side view illustrating the third segment according to the third embodiment of the disclosure.

MODE FOR THE INVENTION

As the disclosure allows for various changes and numerous examples, particular embodiments will be illustrated in the drawings and described in detail in the written description. However, this is not intended to limit the disclosure to particular modes of practice, and it will be understood that all changes, equivalents, and substitutes that do not depart from the spirit and technical scope of various embodiments are en-compassed in the disclosure.

It will be understood that, although the terms first, second, etc. may be used herein to describe various elements, these elements should not be limited by these terms. These terms are only used to distinguish one element from another. For example, a first element could be termed a second element, and, similarly, a second element could be termed a first element, without departing from the scope of the disclosure. As used herein, the term "and/or" includes any and all combinations of one or more of the associated listed items.

When a component is referred to as being "connected" or "accessed" to or by any other component, it should be understood that the component may be directly connected or accessed by the other component, but another new component may also be interposed between them. Contrarily, when a component is referred to as being "directly connected" or "directly accessed" to or by any other component, it should be understood that there is no new component between the component and the other component.

The terms used in the present specification are merely used to describe exemplary embodiments, and are not intended to limit the disclosure. As used herein, the singular forms "a," "an," and "the" are intended to include the plural forms as well, unless the context clearly indicates otherwise. In the present specification, it is to be understood that the terms such as "including," "having," and "comprising" are intended to indicate the existence of the features, numbers, steps, actions, components, parts, or combinations thereof disclosed in the specification, and are not intended to preclude the possibility that one or more other features, numbers, steps, actions, components, parts, or combinations thereof may exist or may be added.

Unless defined otherwise, all terms used herein, including technical terms and scientific terms, have the same meaning as commonly understood by one of ordinary skill in the art to which the disclosure pertains. Such terms as those defined in a generally used dictionary are to be interpreted to have the meanings equal to the contextual meanings in the relevant field of art, and are not to be interpreted to have ideal or excessively formal meanings unless clearly defined in various embodiments of the disclosure.

Reference will now be made in detail to embodiments, examples of which are illustrated in the accompanying drawings. In the drawings, the same elements are denoted by the same reference numerals, and a repeated description thereof will not be given.

An aerosol-generating article according to an embodiment of the disclosure may refer to a cigarette. An aerosol-generating article according to an embodiment of the disclosure may be a cigarette that generates aerosol by combustion. Also, an aerosol-generating article according to an embodiment of the disclosure may be a cigarette that generates aerosol when a part of the cigarette is heated without combustion by a heating source such as a heater assembly.

FIG. 1 is a view for describing an aerosol-generating article according to an embodiment of the disclosure.

Referring to FIG. 1, the aerosol-generating article may include a tobacco rod 100 and a filter rod 200.

The tobacco rod 100 may include an aerosol-generating material. For example, the aerosol-generating material may include at least one of, but not limited to, glycerin, propylene glycol, ethylene glycol, dipropylene glycol, diethylene glycol, triethylene glycol, tetraethylene glycol, and oleyl alcohol.

The tobacco rod 100 may include other additive materials such as a flavoring agent, a wetting agent, and/or an organic acid. For example, the flavoring agent may include licorice, sucrose, fructose syrup, isosweet, cocoa, lavender, cinnamon, cardamom, celery, fenugreek, cascara, sandalwood, bergamot, geranium, honey essence, rose oil, vanilla, lemon oil, orange oil, mint oil, cinnamon, keragene, cognac, jasmine, chamomile, menthol, cinnamon, ylang, salvia, spearmint, ginger, coriander, or coffee. In addition, the wetting agent may include glycerine or propylene glycol.

A flavoring liquid such as menthol or a moisturizer may be sprayed and added to the tobacco rod 100.

The tobacco rod 100 may be filled with a reconstituent tobacco sheet. In another example, the tobacco rod 100 may be filled with tiny bits. The tiny bits may be generated by finely cutting the reconstituent tobacco sheet. In another example, the tobacco rod 100 may be filled with a plurality of tobacco strands obtained by finely cutting the reconstituent tobacco sheet is finely cut. For example, the tobacco rod 100 may be formed by combining the plurality of tobacco strands arranged in the same direction (i.e., arranged parallel to one another) or randomly. For example, the reconstituent tobacco sheet may be manufactured by using the following process. First, a tobacco raw material is crushed to generate a slurry in which an aerosol-generating material (e.g., glycerin or propylene glycol), a flavoring liquid, a binder (e.g., guar gum, xanthan gum, or carboxymethyl cellulose (CMC)), and water are mixed, and then a reconstituent tobacco sheet is formed by using the slurry. Natural pulp or cellulose may be added to make a slurry, and one or more binders may be mixed and used. Tobacco strands may be generated by drying the reconstituent tobacco sheet and cutting or shredding the dried reconstituent tobacco sheet.

The tobacco raw material may be tobacco leaf fragments, tobacco stems, and/or tobacco powder generated during tobacco processing. In addition, the reconstituent tobacco sheet may contain other additives such as wood cellulose fiber. The slurry may contain 5% to 40% of aerosol-generating material, and 2% to 35% of aerosol-generating material may remain in the reconstituent tobacco sheet. Preferably, 5% to 30% of aerosol-generating material may remain in the reconstituent tobacco sheet.

The tobacco rod 100 may be surrounded by a heat conductive material. For example, the heat conductive material may be, but is not limited to, a metal foil such as an aluminum foil. The heat conductive material surrounding the tobacco rod 100 may uniformly distribute heat transmitted to the tobacco rod 100, and thus heat conductivity applied to the tobacco rod 100 may be improved and the flavor of aerosol generated from the tobacco rod 100 may be improved.

The filter rod 200 may contact the tobacco rod 100 and may be located downstream of the tobacco rod 100. The term "downstream" refers to a direction in which the aerosol flows toward the mouth of a user who smokes the aerosol-generating article. On the other hand, the term "upstream direction" may refer to a direction away from the mouth of the user who smokes the aerosol-generating article.

The filter rod 200 may include a plurality of segments. The plurality of segments may be sequentially arranged in a longitudinal direction. The term "longitudinal direction" may refer to a lengthwise direction of the aerosol-generating article.

According to an embodiment, one of the plurality of segments may be a first segment 210. The first segment 210 may be a cellulose acetate filter. For example, the first segment 210 may be a tubular structure having a hollow therein. The hollow may function as a channel through which aerosol passes. A length of the first segment 210 may be an appropriate length within a range of 4 mm to 30 mm, but the disclosure is not limited thereto. Preferably, a length of the first segment 210 may be, but is not limited to, 10 mm A diameter of the hollow (channel) in the first segment 210 may be an appropriate diameter within a range of 3 mm to 4.5 mm, but the disclosure is not limited to.

The first segment 210 may contain a volatile flavor component. The volatile flavor component may be applied as a liquid to the first segment 210. The volatile flavor component may be, but is not limited to, menthol.

According to an embodiment, the first segment 210 may not be included in the filter rod 200. That is, the filter rod 200 may not include the first segment 210, and may include only a second segment 220 and a third segment 230.

One of the plurality of segments may be the second segment 220 capable of filtering a specific component of aerosol. The second segment 220 may be a cellulose acetate filter. A length of the second segment 220 may be appropriately selected within a range of 4 mm to 20 mm. For example, a length of the second segment 220 may be, but is not limited to, about 12 mm.

In a process of manufacturing the second segment 220, the second segment 220 may be manufactured to generate flavor by spraying a flavoring liquid to the second segment 220. Alternatively, a separate fiber to which a flavoring liquid is applied may be inserted into the second segment 220. Aerosol generated by the tobacco rod 100 is cooled as passing through the first segment 210, and the cooled aerosol is delivered to the user through the second segment 220. Accordingly, when a flavoring element is added to the second segment 220, the durability of flavor delivered to the user may be increased.

Any one of the plurality of segments may be the third segment 230. According to an embodiment, the third segment 230 may cool aerosol that is generated when the tobacco rod 100 is burned or when the tobacco rod 100 is heated by a heater. Accordingly, the user may inhale the aerosol cooled to a suitable temperature. According to an embodiment, the third segment 230 may support a wrapper 300 surrounding the segments included in the filter rod 200. Accordingly, a circular shape of the aerosol-generating article may be maintained when the user inhales aerosol. According to an embodiment, the third segment 230 may mix an aerosol airflow. Accordingly, the user may inhale homogenized aerosol. The third segment 230 may include a structure and a channel.

The structure may support the wrapper 300 in a transverse direction. A plurality of structures may be formed. The channel may be formed between the wrapper 300 and the structure. One or a plurality of channels may be formed.

According to an embodiment, the structure may include a plurality of support surfaces contacting an inner circumferential surface of the wrapper 300 in the longitudinal direction. The longitudinal direction may refer to a lengthwise direction of an aerosol-generating device.

The structure may include a plurality of plates extending toward the inner circumferential surface of the wrapper from a central axis that extends in the longitudinal direction (i.e., longitudinal axis). In this case, a plurality of channels may be formed between the plurality of plates. An angle formed between two adjacent plates of the plurality of plates may be 180/n. In this case, n may be a positive integer. For example, the plurality of plates may include a first plate, a second plate, a third plate, and a fourth plate. The second plate may be arranged perpendicular to the first plate. The third plate may be parallel to the first plate with the central axis located in between. The fourth plate may be parallel to the second plate the central axis located in between. In this case, the channel may be formed between plates, and the third segment 230 may include four channels.

According to an embodiment, the structure may include at least one support surface spirally contacting the inner circumferential surface of the wrapper 300 in the longitudinal direction. In this case, the third segment 230 may include a channel for forming a vortex of aerosol around the central axis extending in the longitudinal direction (i.e., the longitudinal axis).

The structure may include a spiral plate member that is spirally formed along the longitudinal axis. In this case, the structure may have a hollow formed along the longitudinal axis. An airflow of aerosol may be formed along the hollow. In another example, a central portion of the structure along the longitudinal axis may be sealed.

The wrapper 300 may be wrapped around the tobacco rod 100 and the filter rod 200. The wrapper 300 may surround outer circumferential surfaces of the tobacco rod 100 and the filter rod 200. According to an embodiment, the tobacco rod 100 and the filter rod 200 may be packaged by one wrapper 300. In another embodiment, the tobacco rod 100 and the filter rod 200 may be packaged by two or more wrappers 300. In detail, the tobacco rod 100 may be packaged by a first wrapper, and the filter rod 200 may be packaged by a second wrapper. The tobacco rod 100 packaged by the first wrapper and the filter rod 200 packaged by the second wrapper may be re-packaged by a third wrapper. In another embodiment, the plurality of segments included in the filter rod 200 may be packaged by different wrappers 300. In detail, the first segment 210 may be packaged by a 3-1$^{st}$ wrapper, the second segment 220 may be packaged by a 3-2$^{nd}$ wrapper, and the third segment 230 may be packaged by a 3-3$^{rd}$ wrapper. The plurality of segments respectively packaged by the wrappers 300 and the tobacco rod 100 packaged by the first wrapper may be re-packaged by one wrapper 300.

The wrapper 300 may have at least one hole through which external air is introduced or internal air is discharged. According to an embodiment, the wrapper 300 may have a hole in a portion surrounding any one segment included in the filter rod 200. For example, the wrapper may have a hole in a portion corresponding to the third segment 230. The wrapper 300 may refer to wrapping paper.

FIG. 2 is a perspective view illustrating a filter rod including a segment according to a first embodiment of the disclosure.

Referring to FIG. 2, a filter rod according to an embodiment of the disclosure may include the first through third segments 210 through 230.

According to an embodiment, as shown in FIG. 2, the segments of the filter rod 200 may be arranged in the order of the first segment 210, the third segment 230, and the second segment 220 along a downstream direction (i.e., a direction in which the aerosol generated in the tobacco rod 100 flows toward the user's mouth). According to another embodiment, the segments of the filter rod 200 may be arranged in the order of the first segment 210, the second segment 220, and the third segment 230 along the downstream direction. According to another embodiment, the segments of the filter rod 200 may be arranged in the order of the third segment 230, the first segment 210, and the second segment 220 along the downstream direction. That is, when the filter rod is divided into an upper end, a middle end, and terminal end, the third segment 230 may be located in any one of the upper end, the middle end, and the terminal end.

The filter rod including the first through third segments 210 through 230 may be packaged by the wrapper 300. That is, the wrapper 300 may surround an outer circumferential surface of the filter rod including the first through third segments 210 through 230. As the wrapper 300 surrounds an outer circumferential surface of the third segment 230, a plurality of channels may be formed between the filter rod and a structure included in the third segment 230.

FIG. 3 is a perspective view illustrating the third segment according to the first embodiment of the disclosure. FIG. 4 is a front view illustrating the third segment according to the first embodiment of the disclosure. FIG. 5 is a side view illustrating the third segment according to the first embodiment of the disclosure.

The third segment 230 according to the first embodiment of the disclosure may include a structure. The wrapper may surround the third segment 230, that is, the structure. As the wrapper 300 surrounds the structure, the third segment 230 may include a plurality of channels formed by the structure and the wrapper 300.

A structure 232 may include a plurality of support surfaces 234 contacting an inner circumferential surface of the wrapper 300 in a longitudinal direction. Referring to FIGS. 3 through 5, the structure 232 may include four support surfaces 234 contacting the wrapper 300. The four support surfaces 234 may be formed in a lengthwise direction of an aerosol-generating device which is the longitudinal direction. The four support surfaces 234 may be symmetric about a central axis C (i.e., longitudinal axis). A first support surface 234-1 and a third support surface 234-3 may be symmetric to each other about the central axis C. A second support surface 234-2 and a fourth support surface 234-4 may be symmetric to each other about the central axis C. Even if a force is applied to the wrapper 300 surrounding an outer circumferential surface of the third segment 230 in a transverse direction, a shape of the filter rod may be maintained because the force may be offset through symmetric support surfaces 234. Although the number of the support surfaces 234 is not limited, it is preferable that the structure 232 includes an even number of support surfaces 234 and paired support surfaces 234 are symmetric to each other about the central axis C.

The structure 232 may include a plurality of plates 232-1 through 232-4 extending from the central axis C of the longitudinal direction to the inner circumferential surface of the wrapper 300. The plurality of plates 232-1 through 232-4 may respectively correspond to the plurality of support surfaces 234-1 through 234-4. That is, each of the plurality of plates 232-1 through 232-4 may include one support surface 234. As the plurality of plates 232-1 through 232-4 extend from the central axis C to the inner circumferential surface of the wrapper 300, forces applied to the wrapper in a transverse direction may be transferred to the central axis C through the support surfaces 234. As the forces transferred to the central axis C are offset, a shape of the filter rod may be maintained.

A certain angle may be formed by every two adjacent plates of the plurality of plates 232-1 through 232-4. In this case, certain angles formed by two plates may be the same. As the certain angles formed by the two plates are the same, forces applied to the wrapper in the transverse direction may be efficiently offset. According to an embodiment, an angle formed by two adjacent plates of the plurality of plates 232-1 through 232-4 may be 360/m. In this case, m may be a positive integer equal to or greater than 2. According to an embodiment, an angle formed by two adjacent plates of the plurality of plates 232-1 through 232-4 may be 180/n. In this case, n may be a positive integer. According to an embodiment, the plurality of plates may be integrally formed. In another embodiment, the plurality of plates 232-1 through 232-4 may be separately formed and then may be coupled to one another. In another example, a pair of plates that are arranged parallel to each other may be integrally formed and then individual plates may be coupled to one another.

The plurality of plates may support other segments connected to a front end a rear end of the third segment 230 or a tobacco rod in the longitudinal direction. Because the plurality of plates provide another support surface for the front end and the rear end of the third segment 230, a shape may be maintained against a force applied to the aerosol-generating device in the longitudinal direction.

Referring to FIGS. 3 through 5, the plurality of plates may include four plates. The plurality of plates may include the first plate 232-1, the second plate 232-2, the third plate 232-3, and the fourth plate 232-4. The first plate 232-1 may extend from the central axis C to the inner circumferential surface of the wrapper 300, and may support the wrapper 300 through the first support surface 234-1. The second plate 232-2 may extend from the central axis C to the inner circumferential surface of the wrapper 300, and may be arranged perpendicular to the first plate 232-1. The second plate 232-2 may support the wrapper 300 through the second support surface 234-2. The third plate 232-3 may extend from the central axis C to the inner circumferential surface of the wrapper 300, and may be parallel to the first plate 232-1 with the central axis C located in between. The third plate 232-3 may support the wrapper 300 through the third support surface 234-3 that is symmetric to the first support surface 234-1 about the central axis C. The fourth plate 232-4 may extend from the central axis C to the inner circumferential surface of the wrapper 300, and may be parallel to the second plate 232-2 with the central axis C located in between. The fourth plate 232-4 may support the wrapper 300 through the fourth support 234-4 that is symmetric to the second support 234-2 about the central axis C. The first plate 232-1 may be at right angles to the second plate 232-2 and the fourth plate 232-4 which are adjacent to the first plate 232-1. The third plate 232-3 may be at right angles to the second plate 232-2 and the fourth plate 232-4 which are adjacent to the third plate 232-3.

A plurality of channels 236 may be formed by the structure 232 and the wrapper 300 surrounding the structure 232. One channel 236 may be formed by two adjacent plates and the wrapper 300 surrounding a space between the two plates. Accordingly, the number of the plurality of plates and the number of the plurality of channels 236 may be the same. When a user smokes, an aerosol airflow may be formed in each of the plurality of channels 236. Because each of the plurality of channels 236 includes a surface of each of two plates and a wrapper surface surrounding the plates, the channel 236 may accelerate cooling of aerosol.

Referring to FIGS. 3 through 5, the third segment 230 may include first through fourth channels 236-1 through 236-4. The first channel 236-1 may be formed by the first plate 232-1, the second plate 232-2, and the wrapper. The second channel 236-2 may be formed by the second plate 232-2, the third plate 232-3, and the wrapper 300. The third channel 236-3 may be formed by the third plate 232-3, the fourth plate 232-4, and the wrapper 300. The fourth channel 236-4 may be formed by the fourth plate 232-4, the first plate 232-1, and the wrapper 300. When the user smokes, an aerosol airflow may be formed in each of the first through fourth channels 236-1 through 236-4. The aerosol airflows may be mixed by collision when passing through a downstream end of the third segment 230, thereby homogenizing aerosol.

FIG. 6 is a perspective view illustrating a filter rod including a third segment according to a second embodiment of the disclosure.

Referring to FIG. 6, the filter rod 200 according to an embodiment of the disclosure may include the first through third segments 210 through 230.

According to an embodiment, as shown in FIG. 6, the segments of the filter rod 200 may be sequentially arranged in the order of the first segment 210, the third segment 230, and the second segment 220 along a downstream direction. According to another embodiment, the segments of the filter rod 200 may be sequentially arranged in the order of the first segment 210, the second segment 220, and the third segment 230 along the downstream direction. According to another embodiment, the segments of the filter rod 200 may be sequentially arranged in the order of the third segment 230, the first segment 210, and the second segment 220 along the downstream direction. That is, when the filter rod 200 is divided into an upper end, a middle end, and a terminal end, the third segment 230 may be located in any one of the upper end, the middle end, and the terminal end.

The filter rod 200 including the first through third segments 210 through 230 may be packaged by the wrapper 300. That is, the wrapper 300 may surround an outer circumferential surface of the filter rod 200 including the first through third segments 210 through 230. As the wrapper 300 surrounds an outer circumferential surface of the third segment 230, a channel may be formed between a structure included in the third segment 230 and the filter rod 200. In this case, the structure may have a spiral shape.

FIG. 7 is a perspective view illustrating the third segment according to the second embodiment of the disclosure. FIG. 8 is a front view illustrating the third segment according to the second embodiment of the disclosure. FIG. 9 is a side view illustrating the third segment according to the second embodiment of the disclosure.

The third segment 230 according to the second embodiment of the disclosure may include the structure 232. The wrapper 300 may surround the third segment 230, that is, the structure 232. As the wrapper 300 surrounds the structure 232, the third segment 230 may include the channel 236 formed by the structure 232 and the wrapper 300.

The structure 232 may include at least one support surface 234 spirally contacting an inner circumferential surface of the wrapper 300 in a longitudinal direction. Referring to FIGS. 7 through 9, the structure 232 may include one support surface 234 contacting the wrapper 300. The one support surface 234 may be spirally formed in a lengthwise direction of an aerosol-generating device which is the longitudinal direction. The support surface 234 that is spirally formed may maintain a certain interval in the longitudinal direction. The support surface 234 that is spirally formed may have a certain angle with respect to a cross-section taken perpendicular to the longitudinal direction. An interval in the longitudinal direction and an angle with respect to the cross-section for the support surface 234 may be changed by one of ordinary skill in the art. Because a force applied to the wrapper 300 surrounding the outer circumferential surface of the third segment 230 in a transverse direction may be offset by the support surface 234 that is spirally formed, a shape of the filter rod 200 may be maintained. Also, the structure 232 may support other segments connected to a front end and a rear end of the third segment 230 or a tobacco rod in the longitudinal direction. Because the structure 232 may provide another support surface for the front end and the rear end of the third segment 230, a shape may be maintained against a force applied to the aerosol-generating device in the longitudinal direction.

The structure 232 may include a spiral plate member that is spirally formed along the central axis C extending in the longitudinal direction (i.e., longitudinal axis). The spiral plate member may have a shape obtained by twisting one plate. According to an embodiment, the spiral plate member may include a first edge a in the lengthwise direction and a second edge b facing the first edge a. The spiral plate member may have a helicoidal shape in which the first edge a surrounds the central axis C and the second edge b is spaced apart from the central axis C by a certain distance. Accordingly, a central portion of the structure 232 along the central axis C of the longitudinal direction may be sealed.

Referring to FIGS. 7 through 9, it is found that the structure 232 includes the spiral plate member. The spiral plate member may include the first edge a and the second edge b, which spirally extend in the longitudinal direction. The first edge a surrounds the central axis C and the second edge b is spaced apart from the central axis C by a certain distance. The support surface 234 having a spiral shape may be located on the second edge b. As the first edge a of the spiral plate member surrounds the central axis C and the second edge b is spaced apart from the central axis C by a certain distance, the central portion of the structure 232 may be sealed. Accordingly, a force applied to the wrapper 300 surrounding the outer circumferential surface of the third segment 230 in the transverse direction may be transferred to the central axis C through the support surface 234 formed on the second edge b, and thus the force may be efficiently offset.

The channel 236 may be formed by the structure 232 and the wrapper 300 surrounding the structure 232. Referring to FIGS. 7 through 9, the channel 236 may be formed by the spiral plate member and the wrapper 300 surrounding the spiral plate member. In this case, one channel 236 may be formed. When a user smokes, an aerosol airflow may be formed in the channel 236. The channel 236 may form a vortex of aerosol around the central axis C. Because the channel 236 is formed by the spiral plate member and a surface of the wrapper 300 surrounding the spiral plate member, a contact area of aerosol passing through the channel 236 may be increased and cooling may be accelerated. In addition, homogenization of the aerosol may be improved due to the vortex.

FIG. 10 is a perspective view illustrating a third segment according to a third embodiment of the disclosure. FIG. 11 is a front view illustrating the third segment according to the third embodiment of the disclosure. FIG. 12 is a side view illustrating the third segment according to the third embodiment of the disclosure.

The third segment 230 according to the third embodiment of the disclosure may include the structure 232. The wrapper 300 may surround the third segment 230, that is, the structure 232. As the wrapper 300 surrounds the structure 232, the third segment 230 may include the channel 236 formed by the structure 232 and the wrapper 300.

The structure 232 may include at least one support surface 234 spirally contacting an inner circumferential surface of the wrapper 300 in a longitudinal direction. Referring to FIGS. 10 through 12, the structure 232 may include one support surface 234 contacting the wrapper 300. The one support surface 234 may be spirally formed in a lengthwise direction of an aerosol-generating device which is the longitudinal direction. The support surface 234 that is spirally formed may maintain a certain interval in the longitudinal direction. The support surface 234 that is spirally formed may have a certain angle with respect to a cross-section taken perpendicular to the longitudinal direction. An interval in the longitudinal direction and an angle with respect to the cross-section for the support surface 234 may be changed by one of ordinary skill in the art.

Because a force applied to the wrapper 300 surrounding an outer circumferential surface of the third segment 230 in a transverse direction may be offset by the support surface 234 that is spirally formed, a shape of a filter rod 200 may be maintained. Also, the structure 232 may support other segments connected to a front end and a rear end of the third segment 230 or a tobacco rod in the longitudinal direction. Because the structure 232 may provide another support surface for the front end and the rear end of the third segment 230, a shape may be maintained against a force applied to the aerosol-generating device in the longitudinal direction.

The structure 232 may include a spiral plate member that is spirally formed along the central axis C. The spiral plate member have a shape obtained by twisting one plate. According to an embodiment, the spiral plate member may include the first edge a and the second edge b, which spirally extend in the lengthwise direction. The spiral plate member may have a helicoidal shape in which the first edge a is spaced apart from the central axis C by a first distance and the second edge b is spaced apart from the central axis C by a second distance. The first distance may be smaller than the second distance. Accordingly, the structure 232 may have a hollow formed along the central axis C.

Referring to FIGS. 10 through 12, the structure 232 includes the spiral plate member. The spiral plate member may include the first edge a and the second edge b, which spirally extend in the lengthwise direction. The first edge a may be spaced apart from the central axis C by the first distance, and the second edge b may be spaced apart from the central axis C by the second distance. The support surface 234 that spirally contacts the wrapper 300 may be located on the second edge b. As the first edge a of the spiral plate member is spaced apart from the central axis C by the first distance and the second edge b is spaced apart from the central axis C by the second distance, the hollow may be formed in a central portion of the structure 232. As the hollow is formed in the structure 232, manufacturing costs of the structure 232 may be reduced.

The channel 236 may be formed by the structure 232 and the wrapper 300 surrounding the structure 232. Referring to FIGS. 10 through 12, the channel 236 may be formed by the spiral plate member and the wrapper 300 surrounding the spiral plate member. When a user smokes, an aerosol airflow may be formed in the channel 236. The channel 236 may form a vortex of aerosol around the central axis C. Because the channel 236 is formed by the spiral plate member and the wrapper 300 surrounding the spiral plate member, a contact area of aerosol passing through the channel 236 may be increased and cooling may be accelerated. In addition, homogenization of aerosol may be improved due to the vortex. An aerosol airflow of a direction different from that of the vortex may be formed through the hollow formed in the central portion of the structure. The aerosol airflow formed along the hollow may collide with the vortex formed along a surface of the spiral plate member, thereby improving homogenization of aerosol.

While the embodiments of the disclosure have been illustrated and described above, the disclosure is not limited to the above-described specific embodiments. Numerous modifications and adaptations will be readily apparent to one of ordinary skill in this art from the detailed description and the embodiments without departing from the spirit and scope of the disclosure. For example, each element in an embodiment may be modified and implemented. It should be understood that differences related to modifications and adaptations are included in the scope of the disclosure defined by the appended claims.

The invention claimed is:

1. An aerosol-generating article comprising:

a tobacco rod;

a filter rod located downstream of the tobacco rod; and a wrapper surrounding outer circumferential surfaces of the tobacco rod and the filter rod, wherein the filter rod comprises:

a structure supporting the wrapper in a transverse direction; and at least one channel formed between the wrapper and the structure, wherein the structure comprises at least one support surface spirally contacting an inner circumferential surface of the wrapper in a longitudinal direction, wherein the structure further comprises a spiral plate member spirally formed along a longitudinal axis, wherein the spiral plate member is a helicoidal flat plate with a portion extending along a direction transverse to the direction in which the filter rod extends and comprises a first edge spaced apart from a central axis of the spiral plate member by a first distance, and a second edge spaced apart from the central axis of the spiral plate member by a second distance, the first distance being less than the second distance, wherein a hollow is formed in a central portion of the structure, wherein the at least one channel comprises a first channel formed between the first edge and an inner surface of the wrapper to form a vortex, and a second channel formed between the first edge and the central axis and forming an aerosol airflow having a different direction than the vortex, and wherein the aerosol airflow formed along the second channel collides with the vortex formed along the first channel.

* * * * *